US007855235B2

(12) United States Patent
Van Hardeveld

(10) Patent No.: US 7,855,235 B2
(45) Date of Patent: Dec. 21, 2010

(54) METHOD TO START A PROCESS FOR PRODUCING HYDROCARBONS FROM SYNTHESIS GAS

(75) Inventor: Robert Martijn Van Hardeveld, Rotterdam (NL)

(73) Assignee: Shell Oil Company, Houston, TX (US)

( * ) Notice: Subject to any disclaimer, the term of this patent is extended or adjusted under 35 U.S.C. 154(b) by 259 days.

(21) Appl. No.: 12/096,403

(22) PCT Filed: Dec. 6, 2006

(86) PCT No.: PCT/EP2006/069353

§ 371 (c)(1), (2), (4) Date: Jun. 6, 2008

(87) PCT Pub. No.: WO2007/065904

PCT Pub. Date: Jun. 14, 2007

(65) Prior Publication Data

US 2008/0306171 A1 Dec. 11, 2008

(30) Foreign Application Priority Data

Dec. 9, 2005 (EP) ..... 05111883

(51) Int. Cl.
*C07C 27/00* (2006.01)

(52) U.S. Cl. ..... 518/705; 518/700; 518/703; 518/706

(58) Field of Classification Search ..... 518/700, 518/703, 705, 706
See application file for complete search history.

(56) References Cited

U.S. PATENT DOCUMENTS

| | | | | |
|---|---|---|---|---|
| 2,602,810 | A | 7/1952 | Montgomery et al. | 260/449.6 |
| 2,610,976 | A | 9/1952 | Martin et al. | 260/449.6 |
| 2,904,576 | A | 9/1959 | McGrath | 260/449.6 |
| 4,127,392 | A | 11/1978 | Watson et al. | 48/197 R |
| 4,626,552 | A | 12/1986 | Arcuri | 518/712 |
| 5,763,716 | A | 6/1998 | Benham et al. | 585/315 |
| 2004/0077736 | A1 | 4/2004 | Steynberg | 518/703 |
| 2005/0027020 | A1 | 2/2005 | Steynberg | 518/718 |

FOREIGN PATENT DOCUMENTS

| | | |
|---|---|---|
| EP | 0152652 | 8/1985 |
| GB | 845558 | 8/1960 |
| WO | WO9306041 | 4/1993 |
| WO | WO9717137 | 5/1997 |
| WO | WO9961550 | 12/1999 |
| WO | WO02059232 | 8/2002 |
| WO | WO03068715 | 8/2003 |
| WO | WO2004015028 | 2/2004 |
| WO | WO2004026994 | 4/2004 |
| WO | WO2005026292 | 3/2005 |
| WO | WO2005026293 | 3/2005 |

OTHER PUBLICATIONS

Oil and Gas Journal, Sep. 6, 1971, pp. 86-90.

*Primary Examiner*—Jafar Parsa

(57) ABSTRACT

A method to start a steady state process for producing normally gaseous, liquid and solid hydrocarbons comprises providing a synthesis gas and catalytically converting the synthesis gas into normally gaseous, liquid or solid hydrocarbons. The process involves using at least a portion of the gaseous hydrocarbons produced as a recycle stream to which hydrogen is added prior to its reintroduction into the reactors and as the activity of the catalyst converting the synthesis gas proceeds from start-up towards a steady state, the amount of recycle stream is reduced.

15 Claims, No Drawings

METHOD TO START A PROCESS FOR PRODUCING HYDROCARBONS FROM SYNTHESIS GAS

The present application claims priority to European Patent Application 05111883.4 filed 9 Dec. 2005.

FIELD OF THE INVENTION

The present invention provides a method to start a catalytic process for producing normally gaseous, normally liquid and optionally solid hydrocarbons from synthesis gas, generally provided from a hydro-carbonaceous feed, for example a Fischer Tropsch process. In particular the present invention provides a method to start an integrated, low cost process for the production of hydrocarbons, especially normally liquid hydrocarbons, from natural gas or associated gas, in particular at remote locations as well as at off-shore platforms. The present invention further provides a process for producing normally gaseous, normally liquid and optionally normally solid hydrocarbons from synthesis gas using a method herein described, as well as hydrocarbons whenever provided by such process.

BACKGROUND OF THE INVENTION

Many documents are known describing processes for the catalytic conversion of (gaseous) hydrocarbonaceous feedstocks, especially methane, natural gas and/or associated gas, into liquid products, especially methanol and liquid hydrocarbons, particularly paraffinic hydrocarbons. In this respect often reference is made to remote locations and/or off-shore locations, where no direct use of the gas is possible. Transportation of the gas, e.g. through a pipeline or in the form of liquefied natural gas, is not always practical. This holds even more in the case of relatively small gas production rates and/or fields. Reinjection of gas will add to the costs of oil production, and may, in the case of associated gas, result in undesired effects on the crude oil production. Burning of associated gas has become an undesired option in view of depletion of hydrocarbon sources and air pollution.

The Fischer Tropsch process can be used for the conversion of hydrocarbonaceous feed stocks into liquid and/or solid hydrocarbons. Generally, the feed stock (e.g. natural gas, associated gas and/or coal-bed methane, coal, biomass, as well as residual (crude) oil fractions) is converted in a first step into a mixture of hydrogen and carbon monoxide (this mixture is often referred to as synthesis gas or syngas). The synthesis gas is then fed into a reactor where it is converted in one or more steps over a suitable catalyst at elevated temperature and pressure into paraffinic compounds ranging from methane to high molecular weight compounds comprising up to 200 carbon atoms, or, under particular circumstances, even more.

Numerous types of reactor systems have been developed for carrying out the Fischer Tropsch reaction. For example, Fischer Tropsch reactor systems include fixed bed reactors, especially multi-tubular fixed bed reactors, fluidised bed reactors, such as entrained fluidised bed reactors and fixed fluidised bed reactors, and slurry bed reactors such as three-phase slurry bubble columns and ebullating bed reactors.

The Fischer Tropsch reaction is very exothermic and temperature sensitive, with the result that careful temperature control is required to maintain optimum operation conditions and desired hydrocarbon product selectivity. Indeed, close temperature control and operation throughout the reactor are major objectives.

Starting up such a process will involve new and regenerated catalyst material. However, catalyst material when new or regenerated is often more active than once it has achieved a steady state activity under reaction conditions. In chemical reactions such as the Fischer Tropsch reaction, which is very exothermic and temperature sensitive as mentioned above, a higher level of activity of a catalyst at the start up of a reactor is of significant concern. In a Fischer-Tropsch reaction, the higher activity can easily result in over-conversion that may result in undesired catalyst de-activation, for example due to higher water production or due to carbonation of the catalyst as a result of a decreased hydrogen-to-carbon monoxide ratio in the synthesis gas.

There is thus required a way of using the initial greater activity of new catalyst material until the reaction process reaches a steady state. Several start-up procedures have been proposed in the prior art to cope with the initial greater activity of the catalyst.

In WO 2005/026292 and WO 2005/026293, for example is disclosed a method for start-up of a hydrocarbon synthesis process in a slurry bubble column. The start-up method comprises a specific procedure for charging the catalyst particles in the conversion reactor. At the end of the charging phase, the reactor is continuously fed with inert gas to prevent catalyst sedimentation. During a subsequent conditioning phase, the temperature is brought to values suitable for conditioning, the inert gas is gradually substituted by synthesis gas up to a concentration ranging from 5-50 vol % and this concentration is maintained for 24-72 hours. Then, the pressure and temperature are gradually increased up to steady state regime values and the concentration of inert gas gradually reduced to zero.

In WO03/068715 is disclosed a process for starting up a Fischer-Tropsch reactor wherein synthesis gas is initially fed to the reactor at a flow rate below the steady state flow rate and having a $H_2$/CO molar ratio above the steady state ratio. The synthesis gas flow rate is then increased and the $H_2$/CO molar ratio in the synthesis gas decreased to the steady state values.

In U.S. Pat. No. 2,602,810 is disclosed a Fischer Tropsch process using, under steady state conditions, a reactor feed stream with a very high $H_2$/CO molar ratio, i.e. at least 15, by combining synthesis gas with a hydrogen-rich recycle stream. The reactor is started by pressuring it with hydrogen, and then starting recycling. The reactor is then brought to a temperature required for initiation of the conversion reaction. Synthesis gas is then fed to the reactor at a low flow rate and hydrogen at a high flow rate. During start-up, the flow rate of synthesis gas is increased while decreasing the flow rate of the hydrogen.

SUMMARY OF THE INVENTION

A novel start-up method for a steady state process for producing hydrocarbons from synthesis gas has been found, wherein the initial synthesis gas partial pressure in the feed stream is reduced whilst the flow rate of synthesis gas and the $H_2$/CO molar ratio in the feed stream to the reactor can be kept constant.

Accordingly, the present invention provides a method to start a steady state process for producing normally gaseous, normally liquid and optionally normally solid hydrocarbons from synthesis gas, which process comprises the steps of:

(i) providing the synthesis gas;

(ii) catalytically converting the synthesis gas in one or more conversion reactors at an elevated temperature and a pressure to obtain the normally gaseous, normally liquid and optionally normally solid hydrocarbons; and (iii) using at least a portion of the gaseous hydrocarbons produced by step (ii) as a recycle stream to be reintroduced into conversion reactor(s) of step (ii);

the method comprising admixing a hydrogen stream with the recycle stream of step (iii) prior to its reintroduction into conversion reactor(s) of step (ii), wherein as the activity of the catalyst converting the synthesis gas proceeds towards a steady state, the amount of recycle stream is reduced.

With the addition of a recycle stream having hydrocarbons produced by step (ii) and optionally further inert material(s), the synthesis gas in the conversion reactor(s) will only have a partial pressure. During start-up, the ratio of the recycle stream/synthesis gas stream entering the conversion reactor(s) is higher than that which is used once the catalyst material in the reactor has reached a steady state of catalytic conversion of the synthesis gas. By having an increased proportion of recycle stream in the feed stream for step (ii) during start-up, the level of inert material in the feed stream is increased, thus further reducing the partial pressure of the synthesis gas. This reduces the over-conversion that would otherwise occur by use of full synthesis gas pressure acting on new or regenerated catalyst material. Thus, the present invention simulates the catalytic carbon monoxide conversion in the conversion reactor at steady state conditions, i.e. the "normalised catalytic conversion", after the initial greater activity period of the new or regenerated catalyst.

Moreover, by using a lower initial partial pressure of synthesis gas in the reactor, no lowering of reaction temperature, to otherwise compensate for the initial greater activity of the catalyst, is required. Thus, high quality steam is produced and the period during which this is not yet produced is minimised. Moreover, a relatively high temperature has a positive effect on preventing water condensation in the reactor.

By using a lower initial partial pressure of synthesis gas in the conversion reactor, there will also be a lower partial pressure of water.

The use of a recycle stream of step (ii) for the addition of inert material to the feed stream is particularly advantageous in a situation wherein a reactor is started alongside one or more reactors that are already on stream, since such recycle stream is then immediately available.

However, the introduction of a varying amount of inert material back into step (ii) can affect the hydrogen to carbon monoxide ($H_2$/CO) molar ratio in the feed stream entering the conversion reactor(s). Thus, the present invention provides a method whereby the $H_2$/CO molar ratio in the feed stream can be adjusted by admixing a hydrogen stream with the recycle stream.

The present invention also provides a process for producing normally gaseous, normally liquid and optionally normally solid hydrocarbons from synthesis gas using a method herein described, as well as hydrocarbons whenever provided by such a process.

DETAILED DESCRIPTION OF THE INVENTION

In the method according to the invention, a steady state hydrocarbon synthesis process is started by providing synthesis gas and a recycle stream admixed with a hydrogen stream to a reactor for catalytically converting the synthesis gas. As the activity of the catalyst converting the synthesis gas proceeds towards a steady state, the amount of recycle stream is reduced.

The steady state process to which the start-up method is applied comprises the following steps:

(i) providing the synthesis gas;

(ii) catalytically converting the synthesis gas in one or more conversion reactors at an elevated temperature and a pressure to obtain the normally gaseous, normally liquid and optionally normally solid hydrocarbons; and (iii) using at least a portion of the gaseous hydrocarbons produced by step (ii) as a recycle stream to be reintroduced into conversion reactor(s) of step (ii).

The recycle stream in step (iii) comprises one or more gaseous hydrocarbons produced by step (ii). Reference herein to gaseous hydrocarbons is to hydrocarbons that are gaseous under the conditions of temperature and pressure at which the hydrocarbons are recycled. This will typically be at ambient temperature the pressure at which step (ii) is operated. Examples of such gaseous hydrocarbons are methane, ethane and propane. These hydrocarbons are inert materials in the sense that they are 'inert' in relation to catalytic conversion step (ii). The recycle stream may comprise such gaseous hydrocarbons in any portion or combination of portions. The recycle stream may comprise further inert materials. Such materials are well known in the art, and include nitrogen and carbon dioxide.

Preferably, the total amount of inert material in the recycle stream, i.e. including the hydrocarbons produced by step (ii), is in the range of from 10 to 70 vol %, more preferably 20 to 60 vol %.

The synthesis gas provided by step (i) and the hydrogen stream admixed with the recycle stream during start-up may already include materials which could be defined as inert material. The total amount of inert gas(es) in the combined synthesis gas, recycle stream and hydrogen stream during start-up could be in the range of from >0 to 99 vol %, preferably 20 to 80 vol %, more preferably 30 to 70 vol %, and even more preferably 40 to 60 vol %, of the combination of the synthesis gas, recycle stream and hydrogen stream.

In the method according to the invention, the amount of recycle stream during start-up is higher compared to the amount of recycle stream during steady state operation of the process, i.e. as the activity of the catalyst converting the synthesis gas proceeds towards a steady state, the amount of recycle stream is reduced. The partial pressure of the synthesis gas is thus increased as the activity of the catalyst converting the synthesis gas proceeds towards a steady state. The partial pressure of the synthesis gas could be increased in a number of stages, but at least in a way wherein its partial pressure is kept close to, preferably below, the expected partial pressure of synthesis gas in the reactor for steady state catalytic conversion.

The initial partial pressure of synthesis gas in a conversion reactor could be any suitable amount lower than the steady state partial pressure of synthesis gas which suits other start up conditions, or the reactor conditions and/or products being provided by such reactor. The initial partial pressure of the synthesis gas in a conversion reactor is preferably 30-80% of the steady state partial pressure of the synthesis gas, more preferably 40-60%.

In general, the initial partial pressure of the synthesis gas entering the conversion reactor(s) during the start up period is in the range 20-70% of the total reactor pressure, preferably 30-60%.

The actual flow rate of synthesis gas entering the synthesis reactor preferably does not change or significantly change during this initial period, but its partial pressure will be such as to simulate as near as possible the normal or steady state space time yield. Thus, the ratio of the recycle stream/synthesis gas entering the conversion reactor during start-up is preferably controlled such that the space time yield of a conversion reactor during the initial or start-up phase is kept at the same value as during steady state operation. Space time yield expresses the yield as weight of $C_1$+ hydrocarbons produced per reactor volume per hour.

In the method according to the invention, a hydrogen stream is admixed with the recycle stream during start-up. Admixture of hydrogen provides for minimising variations on the $H_2/CO$ molar ratio of the feed stream entering the conversion reactor(s). Preferably, the hydrogen stream is admixed in such amount that the $H_2/CO$ molar ratio in the feed stream to synthesis gas conversion step (ii) is kept substantially constant, i.e. generally within 5%, preferably within 2%, during start-up. Preferably, the $H_2/CO$ molar ratio in the feed stream during start-up is kept at the same value as during steady state operation. After start-up, the amount of hydrogen stream admixed with the recycle stream is preferably reduced to zero.

The hydrogen stream may be pure hydrogen, i.e. having >99% purity, and without carbon monoxide. Alternatively the hydrogen stream may only need to be sufficiently pure to provide the intended effect of the invention. Sources of partially, substantially or wholly pure hydrogen are known in the art. A particularly suitable source is Steam Methane Reforming (SMR), which provides a hydrogen stream with a high $H_2/CO$ ratio through the reaction:

$$2CH_4+2H_2O \rightarrow 2CO+6H_2$$

The methane in the above reaction can be provided from natural gas, for example the same natural gas as is used to form the synthesis gas. Whilst the above reaction gives a theoretical $H_2/CO$ molar ratio of 3, in fact secondary reactions, such as the water-gas shift reaction between carbon monoxide and water, increase the hydrogen content, and thus increase the $H_2/CO$ molar ratio.

Preferably, where an SMR product stream is used, it is used directly as the hydrogen stream, without any further treatment, for example purification. Optionally, some of the CO in any hydrogen manufacturing process, such as SMR, could be removed.

In one embodiment of the present invention, the hydrogen stream has a $H_2/CO$ molar ratio greater than 3, preferably in the range of 4 to 8, more preferably 5 to 7.

Preferably, the pressure in a conversion reactor is wholly or substantially constant, that is generally 5%, preferably within 2%, during the start up or initial period, until the activity of the catalyst in the conversion reactor has reached a steady state of conversion of the synthesis gas.

The term "steady state" as used herein is a term well known in the art, and relates to a constant or regular, relative to the matter involved, value or position over a period of time. Minor variation in all chemical reactions is common even for a steady state process, but a steady state process is well known in the art wherein the expected output or result is relatively predictable over time. Such conditions may or may not also be optimal, or to provide optimum results.

Another definition of "steady state" relates to the overall and individual conditions, including pressures and temperatures, of the hydrocarbon synthesis plant design. Such conditions are fundamental conditions set for the plant, and their selection would be known to a person skilled in the art.

The term "steady state" is similarly used herein in relation to pressure and temperature and catalyst activity. In a conversion reactor, pressure is usually related to that at the top of the reactor.

In relation to catalyst activity, new or regenerated catalyst when first used can have as much as 70% or higher greater activity of the expected or design or steady state activity. This heightened activity naturally reduces as the catalyst is used from the start up. Thus, the initial catalyst activity can be in the range 120-170%, preferably in the range 135-140%, of the steady state catalyst activity.

Thus, the present invention extends to providing a method to start new reactors, or start re-activated reactors, or to start new or re-activated reactors alongside existing running reactors (swing-in). Under swing-in circumstances, a recycle stream may be immediately available, and a source of hydrogen for the hydrogen stream may also be immediately available from a process connected or associated with the overall hydrocarbon synthesis plant.

The present invention is particularly suitable for integrated processes. One other usual product of the Fischer-Tropsch reaction is the provision of steam, and one further effect of the present invention is to provide in minimal time steam of sufficient quality for use in other parts of the process, or ancillary or other connected processes, units or apparatus, such as an air separation unit (ASU). Such an ASU may for example be used to provide oxygen-enriched air or substantially pure oxygen for the partial oxidation of a hydrocarbonaceous feedstock in order to provide synthesis gas (step (i) of the process for producing hydrocarbons). ASUs are often powered by steam-driven turbines, which generally require steam of sufficient quality, generally pressure, as a power source.

Preferably, the initial temperature for the catalytic conversion of the synthesis gas, i.e. the temperature at start-up, is wholly or substantially the same as the plant design, or steady state, temperature. At conditions of a high total reactor pressure at start up, for example 45 bar (absolute) or higher, it may be advantageous to start the method with an initial temperature that is lower than the plant design or steady state temperature in order to avoid over-conversion. The temperature could then be adjusted to the steady state temperature as soon as the catalyst activity is decreased to such level that over-conversion does not occur under the prevailing total reactor pressure and synthesis gas partial pressure. If a lower initial temperature is used in any of the conversion reactors, the initial temperature may be in the range >0-30° C. lower than the steady state temperature, preferably 5-15° C. lower.

Preferably, the temperature regime used in each conversion reactor to which the method of the present invention applies is wholly or substantially the same or similar. Also preferably, the or each conversion reactor to which the invention applies has the same space time yield (STY).

Where the catalytic conversion of synthesis gas in step (ii) provides steam, the present invention includes the provision of using the steam obtained in step (ii)) for generating power in the providing of the synthesis gas for step (i), once the temperature is approximately the same as or above the steady state temperature.

The present invention provides the use of a hydrogen stream to influence the $H_2/CO$ molar ratio in a feed stream into a Fischer-Tropsch reactor. As mentioned above, the hydrogen may not be pure hydrogen, and can be provided by various processes, such as the SMR process described above. Indeed, the use of SMR process provides a further benefit to the present invention. It provides an integrated process for synthesis gas production and conversion of carbonaceous feedstocks to hydrocarbonaceous products (including for example light and heavy paraffins, methanol and the like). One of the advantages of such an integrated process is the ability to help balance the energy requirements/output of various steps of a Fischer-Tropsch plant overall system, and thus improve the overall efficiency (in terms of carbon efficiency and thermal efficiency) of the Fischer-Tropsch process as a whole.

The method of the present invention is usable for processes involving more than one hydrocarbon conversion reactor, preferably 2 to 10 reactors. Such reactors may be in an arrangement or system with one or more other conversion reactors.

In the method of the present invention, at least the conversion reactor(s) to which the invention applies are preferably connected, either in parallel, in series, or both.

In the present invention, the method of using a lower initial synthesis gas pressure in a reactor is preferably used in all the conversion reactors to which the invention applies. The method could be applied to each conversion reactor in a simultaneous manner. This arrangement may be suitable where the catalyst in the conversion reactor(s) is pre-activated, and does not require activation in situ.

In another embodiment of the present invention, each conversion reactor to which the invention applies is started at a different time. In one way, the method is therefore applied sequentially to each relevant conversion reactor. This arrangement may be suitable where each conversion reactor undergoes catalyst activation in situ. This arrangement is particularly suitable where resources are only able or only suitable for providing catalyst activation of one or two conversion reactors at a time.

Generally, a conversion reactor takes a number of weeks from its start up before it reaches a steady state. Such period can be in the range 1-8 weeks or longer, more usually 2-5 weeks. Where the arrangement is for applying the method the present invention to a number of conversion reactors sequentially, then there will be a cumulative time period before all the conversion reactors have reached a steady state, such that the initial lower pressure of the synthesis gas can then be raised in all the conversion reactors to the steady state total pressure.

The present invention could involve a multi-stage conversion process which may involve, two, three, or more conversion stages, preferably two. Each stage comprises at least two conversion parallel reactors. Generally, the CO conversion level for each stage of a multi-stage process of the present invention is approximately the same.

In a multi-stage process, a hydrogen stream could be added to a recycle stream for one, more than one, or each stage, to influence the $H_2$/CO molar ratio in the entry syngas for the relevant stage(s). The type and amount of hydrogen stream for each relevant stage may be the same or different to the type and amount of hydrogen stream(s) for each other stage.

Preferably, the CO conversion per stage for each stage of a multi-stage conversion process is in the range 70-95%, and more preferably about 80-95%.

In the present invention, one or more of the conversion reactors involved in the method of the present invention have a gas product recycle system or arrangement, more preferably the conversion reactors have a common gas recycle. With a common recycle, preferably all the conversion reactors to which the method applies operate at the same total reactor pressure. In a multi-stage process, all conversion reactors in one stage preferable have a common recycle system. More preferably, each stage has a common recycle system.

As mentioned above, the process to which the present start up invention applies could involve a number of conversion reactors. In one embodiment, the process for producing hydrocarbons by catalytically converting synthesis gas could be used in at least three, preferably 4 to 15, more preferably 6 to 10 conversion reactors, and not all of the conversion reactors, optionally between 25-75% of the reactors, preferably between 40-60% of the reactors, use the method to start of the present invention. In such a situation, the process for producing hydrocarbons in at least one of the remaining conversion reactors for step (ii) could already be operating such that the method of the present invention is to bring into operation one or more further catalytically converting reactors.

In step (i) of the process of producing hydrocarbons, synthesis gas is provided. The synthesis gas can be provided by any suitable means, process or arrangement. This includes partial oxidation and/or reforming of a hydrocarbonaceous feedstock as is known in the art. The hydrocarbonaceous feedstock may be a gaseous or solid feedstock. Suitable solid feedstocks are for example coal and biomass, preferably lignocellulosic biomass. Suitable gaseous feedstocks are known in the art and include natural gas, associated gas, methane or a mixture of $C_1$-$C_4$ hydrocarbons. The partial oxidation of gaseous feedstocks, producing mixtures of especially carbon monoxide and hydrogen, can take place according to various established processes. These processes include the Shell Gasification Process. A comprehensive survey of this process can be found in the Oil and Gas Journal, Sep. 6, 1971, pp 86-90.

The $H_2$/CO molar ratio of the synthesis gas that is provided in step (i) is suitably between 1.5 and 2.3, preferably between 1.8 and 2.1. The $H_2$/CO molar ratio of synthesis gas produced via partial oxidation or reforming may be adjusted before considering the recycle and hydrogen streams, for example by introducing carbon dioxide and/or steam into the partial oxidation process or by admixing additional hydrogen with the synthesis gas as produced.

If the synthesis gas is provided by partial oxidation of a hydrocarbonaceous feedstock, a molecular oxygen containing gas is needed for the partial oxidation of the feedstock. This molecular oxygen containing gas can be air, oxygen enriched air, or substantially pure air. Production of oxygen or oxygen enriched air typically involves air compression and air separation, usually via cryogenic techniques but a membrane based process could also be used, e.g. the process as described in WO 93/06041. A turbine usually provides the power for driving at least one air compressor or separator of the air compression/separating unit. If necessary, an additional compressing unit may be used between the air separation process and the provision of synthesis gas (step (i)). The turbine and/or the optional additional compressing unit are preferably driven by steam generated in step (ii).

If desired, (small) additional amounts of hydrogen may be made by steam methane reforming, preferably in combination with the water shift reaction. Any carbon monoxide and carbon dioxide produced together with the hydrogen may be used in the hydrocarbon synthesis reaction or recycled to increase the carbon efficiency. Additional hydrogen manufacture may be an option.

The steady state catalytic synthesis gas conversion process may be performed under conventional synthesis conditions known in the art. Typically, the catalytic conversion may be effected at a temperature in the range of from 100 to 600° C., preferably from 150 to 350° C., more preferably from 180 to 270° C. Typical total reactor pressures for the catalytic conversion process are in the range of from 1 to 200 bar absolute, more preferably from 10 to 100 bar absolute, even more preferable from 20 to 70 bar absolute.

Catalysts used in step (ii) of the process for producing hydrocarbons are known in the art and are usually referred to as Fischer-Tropsch catalysts. Catalysts for use in the Fischer-Tropsch hydrocarbon synthesis process frequently comprise, as the catalytically active component, a metal from Group VIII of the previous IUPAC version of the Periodic Table of Elements such as that described in the 68th Edition of the Handbook of Chemistry and Physics (CPC Press). Particular catalytically active metals include ruthenium, iron, cobalt and nickel. Cobalt is a preferred catalytically active metal.

It depends on the catalyst and the process conditions used in a Fischer-Tropsch reaction which hydrocarbon products are obtained. Preferably, a Fischer-Tropsch catalyst is used, which yields substantial quantities of paraffins, more preferably substantially unbranched paraffins. A most suitable catalyst for this purpose is a cobalt-containing Fischer-Tropsch catalyst.

The hydrocarbons produced in the process mentioned in the present description are suitably $C_{3-200}$ hydrocarbons, more suitably $C_{4-150}$ hydrocarbons, especially $C_{5-100}$ hydrocarbons, or mixtures thereof. These hydrocarbons or mixtures thereof are liquid or solid at temperatures between 5 and 30° C. (1 bar), especially at about 20° C. (1 bar), and usually are paraffinic of nature, while up to 30 wt %, preferably up to 15 wt %, of either olefins or oxygenated compounds may be present. Typically, mainly (at least 70 wt %, preferably 90 wt %) of $C_5$+ hydrocarbons are formed.

A part of the hydrocarbons produced in step (ii) may boil above the boiling point range of the so-called middle distillates. The higher boiling range paraffinic hydrocarbons, if present, may be isolated and subjected to a catalytic hydrocracking step, which is known per se in the art, to yield the desired middle distillates.

Therefore, the hydrocarbon synthesis process to which the start-up method according to the invention is applied preferably further comprises the step of:

(iv) catalytically hydrocracking higher boiling range paraffinic hydrocarbons produced in step (ii).

The catalytic hydrocracking is carried out by contacting the paraffinic hydrocarbons at elevated temperature and pressure and in the presence of hydrogen with a catalyst containing one or more metals having hydrogenation activity, and supported on a carrier with tailored acidity. Suitable hydrocracking catalysts are known in the art and include catalysts comprising metals selected from Groups VIB and VIII of the (same) Periodic Table of Elements. Preferably, the hydrocracking catalysts contain one or more noble metals from Group VIII. Preferred noble metals are platinum, palladium, rhodium, ruthenium, iridium and osmium. Most preferred catalysts for use in the hydrocracking stage are those comprising platinum. The amount of catalytically active metal present in the hydrocracking catalyst may vary within wide limits and is typically in the range of from about 0.05 to about 5 parts by weight per 100 parts by weight of the carrier material.

Suitable conditions for the catalytic hydrocracking are known in the art. Typically, the hydrocracking is effected at a temperature in the range of from about 175 to 400° C. Typical hydrogen partial pressures applied in the hydrocracking process are in the range of from 10 to 250 bar.

The hydrocarbon synthesis process may be operated in a single pass mode ("once through") or in a recycle mode. As mentioned before, the process may be carried out in one or more reactors, either parallel or in series. Slurry bed reactors, ebullating bed reactors and fixed bed reactors may be used, the fixed bed reactor being the preferred option, although the method of the present invention is also particularly suitable for a Fischer-Tropsch plant using one or more slurry bed reactors, as it is important in slurry bed reactors to minimise disturbances and variations in pressure used in such reactors.

Any percentage mentioned in this description is calculated on total weight or volume of the composition, unless indicated differently. When not mentioned, percentages are considered to be weight percentages. Pressures are indicated in bar absolute, unless indicated differently.

What is claimed is:

1. A method to start a steady state process for producing normally gaseous, normally liquid and optionally normally solid hydrocarbons from synthesis gas, which process comprises the steps of:

(i) providing a synthesis gas;

(ii) catalytically converting the synthesis gas in one or more conversion reactors at an elevated temperature and a pressure to obtain the normally gaseous, normally liquid and optionally normally solid hydrocarbons; and (iii) using at least a portion of the gaseous hydrocarbons produced by step (ii) as a recycle stream to be reintroduced into conversion reactor(s) of step (ii);

the method comprising admixing a hydrogen stream with the recycle stream of step (iii) prior to its reintroduction into conversion reactor(s) of step (ii), wherein as the activity of the catalyst converting the synthesis gas proceeds from start-up towards a steady state, the amount of recycle stream is reduced over a period of up to eight weeks.

2. The method as claimed in claim 1 wherein the recycle stream comprises inert material in an amount in the range of from 10 to 70 vol.

3. The method as claimed in claim 1 wherein the initial partial pressure of the synthesis gas entering the conversion reactor(s) is in the range of from 20 to 70% of the total reactor pressure.

4. The method as claimed in claim 1 wherein the hydrogen stream has a $H_2$/CO molar ratio greater than 3.

5. The method as claimed in claim 1 wherein the hydrogen stream is provided by a steam methane reforming process.

6. The method as claimed in claim 1 wherein the hydrogen stream is pure hydrogen.

7. The method as claimed in claim 1 wherein step (ii) is carried out in at least two conversion reactors.

8. The method as claimed in claim 7, wherein step (ii) is carried out in at least 3 conversion reactors, wherein the method to start with an admixture of hydrogen and a recycle stream is used in at least one but not all of the conversion reactors.

9. The method as claimed in claim 8 wherein one or more of the remaining conversion reactors are already catalytically converting synthesis gas.

10. The method as claimed in claim 7 wherein the recycle stream is used in more than one of the conversion reactors.

11. The method as claimed in claim 7 wherein all the conversion reactors have a common recycle system.

12. The method as claimed in claim 1 wherein the process for the production of hydrocarbon products is a multi-stage process involving 2 to 4 stages.

13. The method as claimed in claim 12 wherein all the conversion reactors of each stage have a common recycle system.

14. The method as claimed in claim 1 wherein any steam obtained in step (ii) is used for generating power in the providing of the synthesis gas for step (i).

15. The method as claimed in claim 1 wherein the process further comprises the step of:

(iv) catalytically hydrocracking higher boiling range paraffinic hydrocarbons produced in step (ii).

* * * * *